US008091895B2

(12) United States Patent
Allen

(10) Patent No.: US 8,091,895 B2
(45) Date of Patent: Jan. 10, 2012

(54) TARGET POSITIONING SYSTEM

(75) Inventor: Terry Kenneth Allen, Otis Orchards, WA (US)

(73) Assignee: Terry Kenneth Allen, Otis Orchards, WA (US)

( * ) Notice: Subject to any disclaimer, the term of this patent is extended or adjusted under 35 U.S.C. 154(b) by 0 days.

(21) Appl. No.: 12/586,621

(22) Filed: Sep. 25, 2009

(65) Prior Publication Data

US 2011/0074112 A1 Mar. 31, 2011

(51) Int. Cl.
*F41J 1/10* (2006.01)

(52) U.S. Cl. ..... 273/407; 108/4; 108/147.2; 248/173

(58) Field of Classification Search ..... 273/348, 273/403–410; 108/1–10, 129, 141, 147.19–147.22, 108/156; 248/173, 439
See application file for complete search history.

(56) References Cited

U.S. PATENT DOCUMENTS

| | | | | | |
|---|---|---|---|---|---|
| 215,033 | A * | 5/1879 | Wright et al. | ..... | 273/407 |
| 1,291,898 | A * | 1/1919 | Hughes | ..... | 108/129 |
| 2,875,008 | A * | 2/1959 | Grodsky | ..... | 108/62 |
| 3,501,149 | A * | 3/1970 | Meyer | ..... | 273/407 |
| 3,610,224 | A * | 10/1971 | Marshall | ..... | 126/19 R |
| 4,625,974 | A * | 12/1986 | Andrews | ..... | 273/407 |
| 4,884,658 | A * | 12/1989 | Banfield | ..... | 182/129 |
| 4,991,325 | A * | 2/1991 | Teduschi | ..... | 38/138 |
| 5,145,133 | A * | 9/1992 | France | ..... | 248/168 |
| 5,816,579 | A * | 10/1998 | Broussard et al. | ..... | 273/408 |
| 5,829,753 | A * | 11/1998 | Wiser | ..... | 273/407 |
| 5,918,553 | A * | 7/1999 | Hellwig et al. | ..... | 108/147.19 |
| 7,458,403 | B2 * | 12/2008 | Radermacher | ..... | 144/286.1 |
| 7,677,510 | B2 * | 3/2010 | Tang | ..... | 248/188.5 |
| 7,780,126 | B2 * | 8/2010 | Law et al. | ..... | 248/168 |
| 2004/0129844 | A1 * | 7/2004 | Doyle | ..... | 248/188.8 |
| 2004/0214665 | A1 * | 10/2004 | Kane et al. | ..... | 473/433 |
| 2006/0157938 | A1 * | 7/2006 | Box et al. | ..... | 273/403 |
| 2007/0045965 | A1 * | 3/2007 | Bateman et al. | ..... | 273/407 |
| 2009/0134581 | A1 * | 5/2009 | Box | ..... | 273/403 |
| 2010/0171398 | A1 * | 7/2010 | Berthiaume et al. | ..... | 312/195 |

* cited by examiner

*Primary Examiner* — Mark Graham

(57) ABSTRACT

Target positioning system with a rectangular flat table top member having downwardly disposed side walls and three primary legs to support the table top member. Two primary legs are hingedly attached to the left and right rear corners of the table top member. One primary leg is hingedly attached under the center front portion of the table top member. Each leg has a telescoping secondary leg member that is capable of being affixed to the to the primary leg member to adjust the height of the primary leg member. The table top member left and right side walls include slots for receiving a strap. The strap can be adjusted in length to hold a standard archery target cube. The flat table top member includes upwardly facing flange located at the rear edge of the table top to prevent the target block from being thrust backward during target practice.

7 Claims, 8 Drawing Sheets

TARGET POSITIONING SYSTEM

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of archery accessories and more specifically to a target positioning system.

Archers often practice to increase their accuracy and skill by shooting at targets. One type of target is a cube type target that sits on the ground and is made of foam material covered by a vinyl sheet material. One such target is called the Broadhead Target made by American Whitetail Inc.

Some archers set the cube on a table top to more accurately approximate the height of a deer or other animal that they might be aiming at in an actual hunting activity.

However there is a deficiency in the prior technology in that the cube, when set on a table, may not represent the actual height of the animal, or simulate closely enough the actual conditions of using a bow and arrow in a hunting situation. For example, an elk is significantly taller than a deer so a practice target should be set higher for elk than deer. A second example is when one might want to practice shooting down at a target as if perched in a tree while the prey is located nearby on the ground. In this case it would be ideal for the cube to be angled so that the face of the cube is approximately perpendicular to the angle of the arrow. Additionally, of a cube type target is placed on a standard table, it may be moved or even knocked off of the table surface by the force of the arrow entering the cube. Finally, the table itself may be knocked over or turned by the force of the arrow hitting the cube.

BRIEF SUMMARY OF THE INVENTION

The primary object of the invention is to provide an archery target positioning system that allows an archer to adjust the target's height to correspond to a particular animals size and correct trajectory of shot.

Another object of the invention is to provide a target positioning system that allows an archer to adjust the target's angle for practicing angled shots to resemble a down-hill or tree-stand shot.

Another object of the invention is to provide a target positioning system that is collapsible for compact storage, carrying and shipping.

A further object of the invention is to provide a target positioning system whose target holding surface includes restraining members to help keep the target from shifting from side to side during the impact of the arrow.

Yet another object of the invention is to provide a target positioning system that accommodates several sizes of block style targets by use of an adjustable strap.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed target positioning system comprising: a rectangular flat table top member having downwardly disposed side walls, three primary legs to support said table top member, two said primary legs hingedly attached to the left and right rear corners of said table top member, one said primary leg hingedly attached under the center front portion of said table top member, each said leg having a telescoping secondary leg member, and each said secondary leg member capable of being attached, by means of a spring loaded pin that passes through aligning apertures in both said leg members to said to said primary leg member to adjust the height of said leg member, said table top member left and right side walls including centrally disposed slots for receiving a flexible strap, said strap capable of being adjusted by standard clasp means to removably retain a standard archery target.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
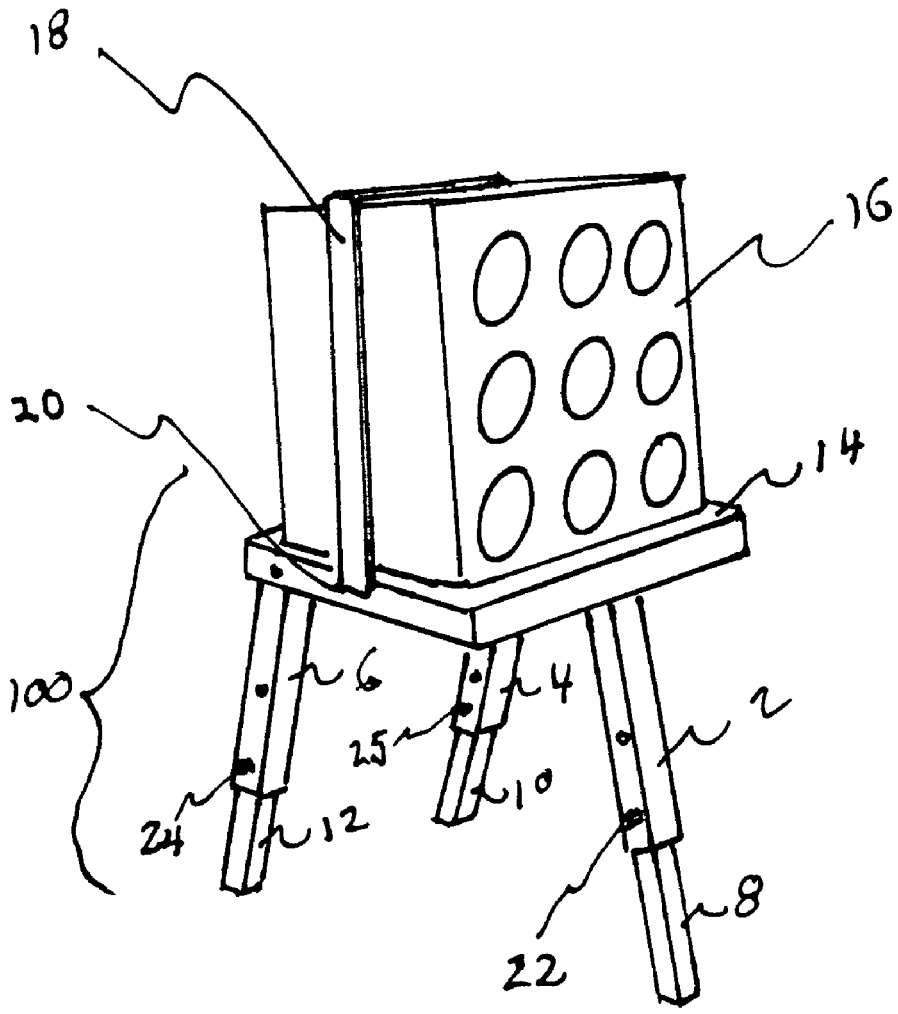
FIG. 1 is a perspective view of the invention holding a standard archery target.

Referring now to FIG. 1 we see a perspective view of the invention 100 The invention 100 is an adjustable table device that includes a table surface 14, three adjustable legs 2, 4, 6 and a strap 18. The strap 18 is slid through slots 20, 21 in the side walls of the table member 14 and can be adjusted by standard clasp means to removably retain a standard archery target 16. Normally these types of targets are placed on the ground, or perhaps on a non-adjustable table top for practice shooting. However, when practicing to shoot an animal such as a deer, it is desirable to have the target 16 set at the height of a deer's body. An elk is a larger, taller animal and therefore, when practicing to shoot at an elk, the target 16 should be set higher. To this end primary legs 2, 4, 6 have secondary telescoping legs 8, 10, 12 that are slidable and can be adjusted by spring loaded pins 22, 24, 25 that slide through aligning apertures in the primary legs and the secondary legs. In this way, the user can adjust the legs so that the target 16 matches the height of the animal that the user intends to shoot at.

Figure 2:
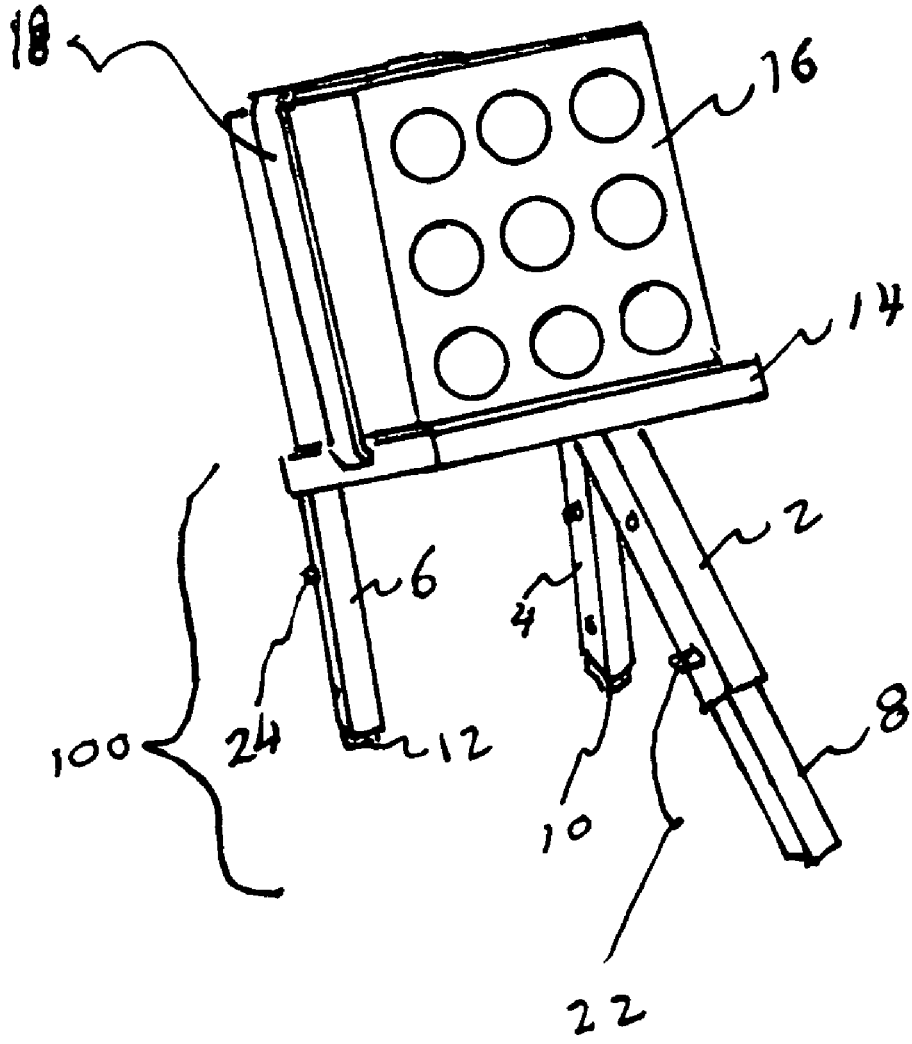
FIG. 2 is a perspective view of the invention set at an angle.
Figure 3:
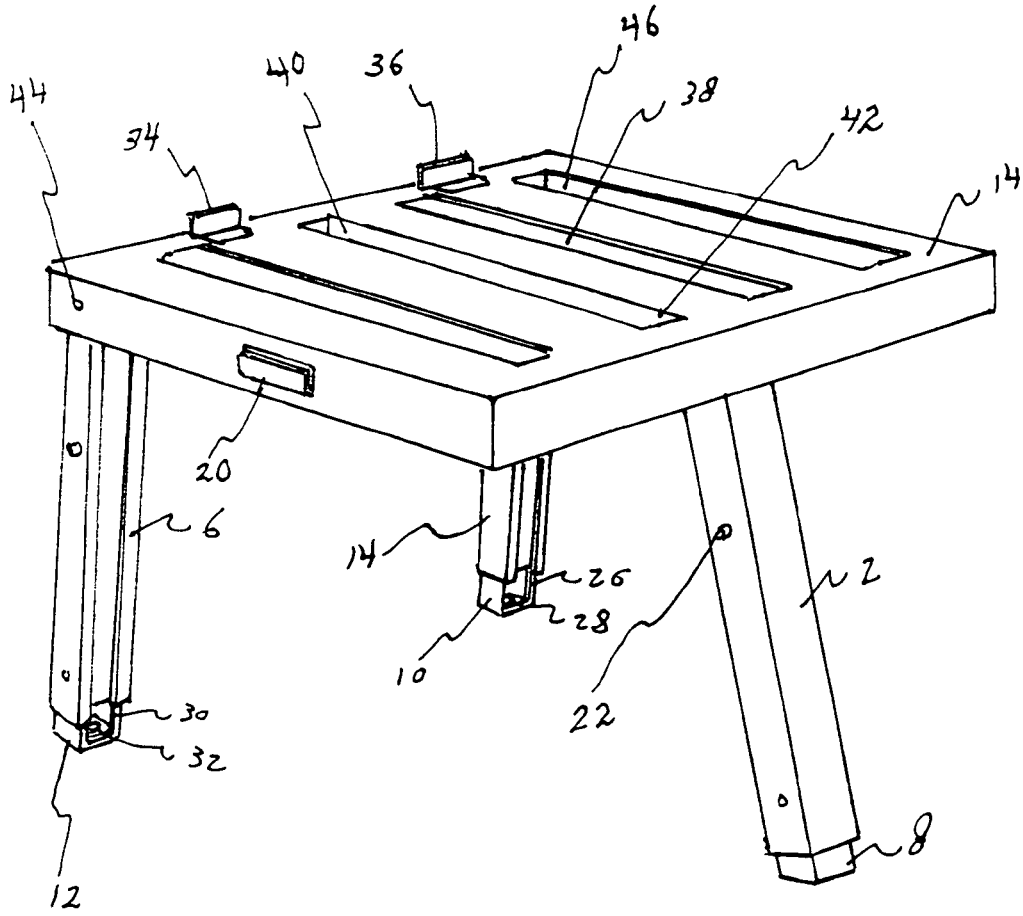
FIG. 3 is a front perspective view of the invention.

FIG. 2 shows a perspective view of the invention 100 with the front leg 2,8 in an extended position. This type of angled target 16 allows the user to practice as if shooting down hill or, if the user can climb a tree, to practice shooting down from the tree to the target 16.

Figure three shows a front perspective view of the invention 100. This view shows that there are two tabs 34, 36 that a target 18 can be placed against. In this way, the force of an arrow hitting the target 16 will not cause the target 16 to be moved backwards, as would be the case if there were no tabs 34, 36. This view also shows cutout portions 26, 30 at the base of secondary legs 10, 12. Apertures 28, 30 located at the base plate of each secondary leg 10, 12 allow the user to stake the legs to the ground thereby further securing the invention 100 so that it will not move when an arrow strikes the target 16. The table top is shown with slots 38 to lighten the overall weight of the unit 100. In the preferred embodiment the invention 100 is constructed of eighteen gauge galvanized stainless steel. This view also shows side support rails 40, 46 that help hold the primary legs 2, 14 in place. pivot pin 42 can be seen as the rotational hinge point for leg 2.

Figure 4:
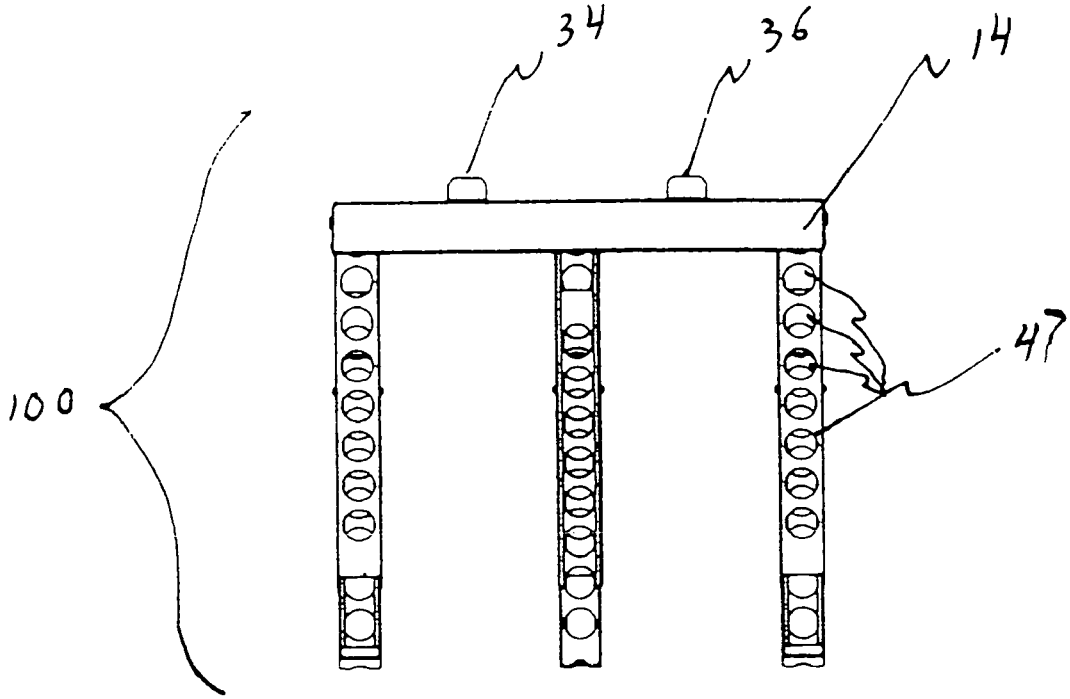
FIG. 4 is a a front view of the invention.

FIG. 4 shows a front view of the invention. In this rendition lightening holes 47 are shown which would further lighten the overall weight of the invention 100 making is easier to carry for a long distance. Retaining tabs 34, 36 can be clearly seen.

Figure 5:
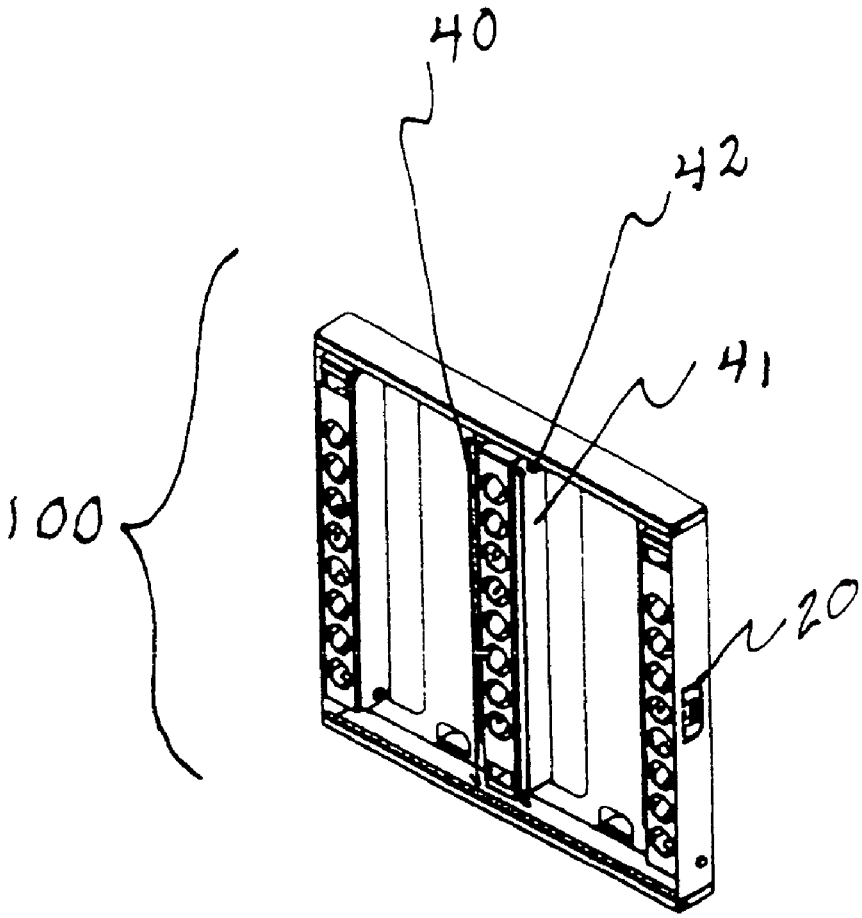
FIG. 5 is a perspective view of the invention in the folded position.

FIG. 5 shows the invention 100 in a folded position making it very compact for carrying or shipping. The strap 18 can be inserted in slots 20 and used as a shoulder strap when transporting the invention 100

Figure 6:
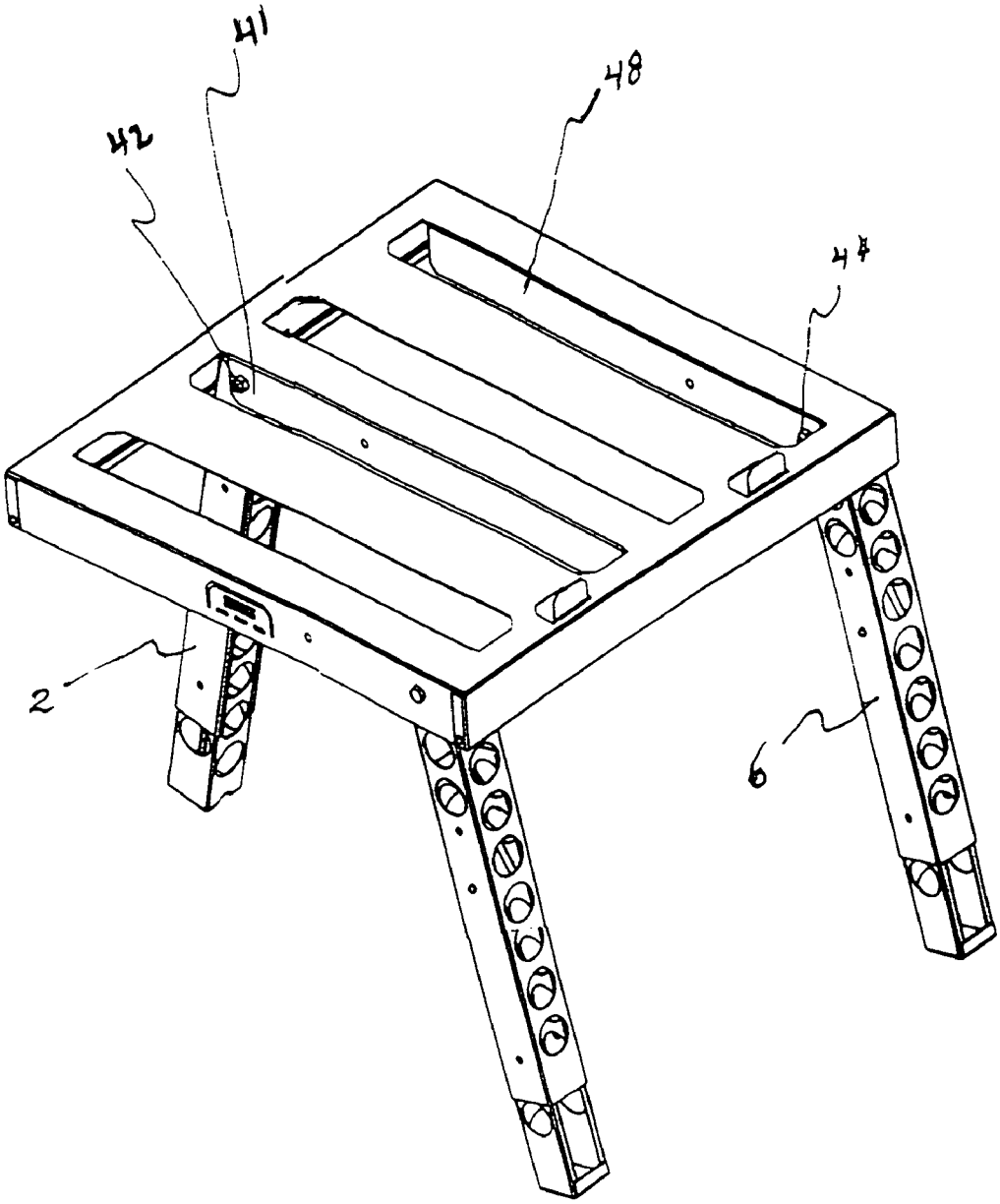
FIG. 6 is a rear perspective view of the invention.

FIG. 6 is a rear perspective view of the invention. Side rails 41, 48 can be clearly seen and help support legs 2, 6. pivot pins 42, 44 can be seen as the rotational hinge point of legs 2 and 6.

Figure 7:
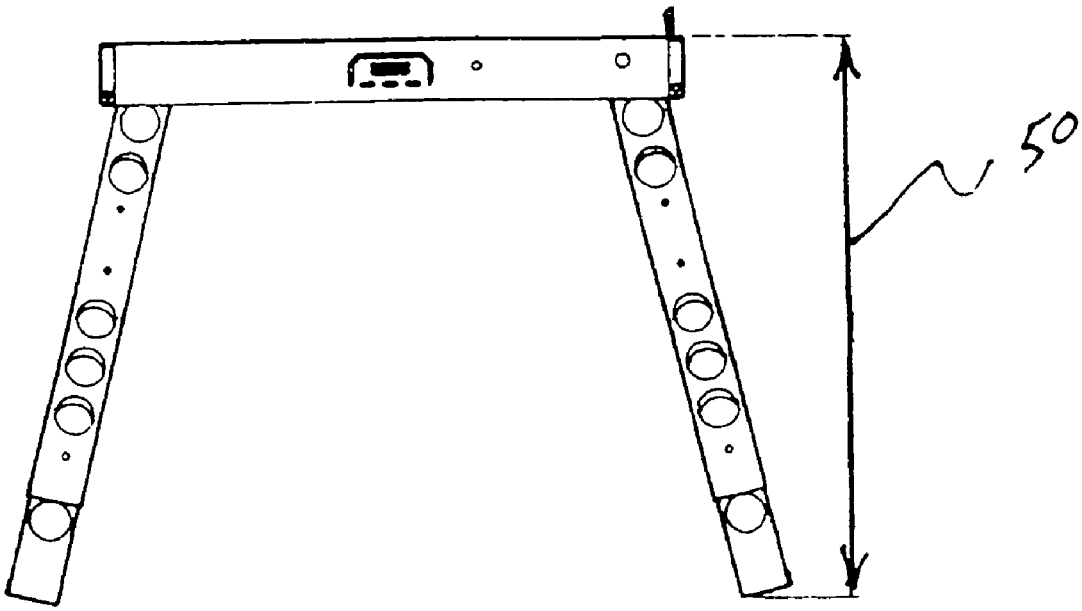
FIG. 7 is a side view of the invention in the lowered position.

FIG. 7 shows a side view of the invention 100 in the lowered position where the height 50 of the table top is approximately eighteen inches however the minimum height is approximately sixteen inches. In the lowered position the centerline of a standard block foam style target that is strapped to the table top will be approximately 26 to 28 inches which is relative to the vital shooting height of a deer.

Figure 8:
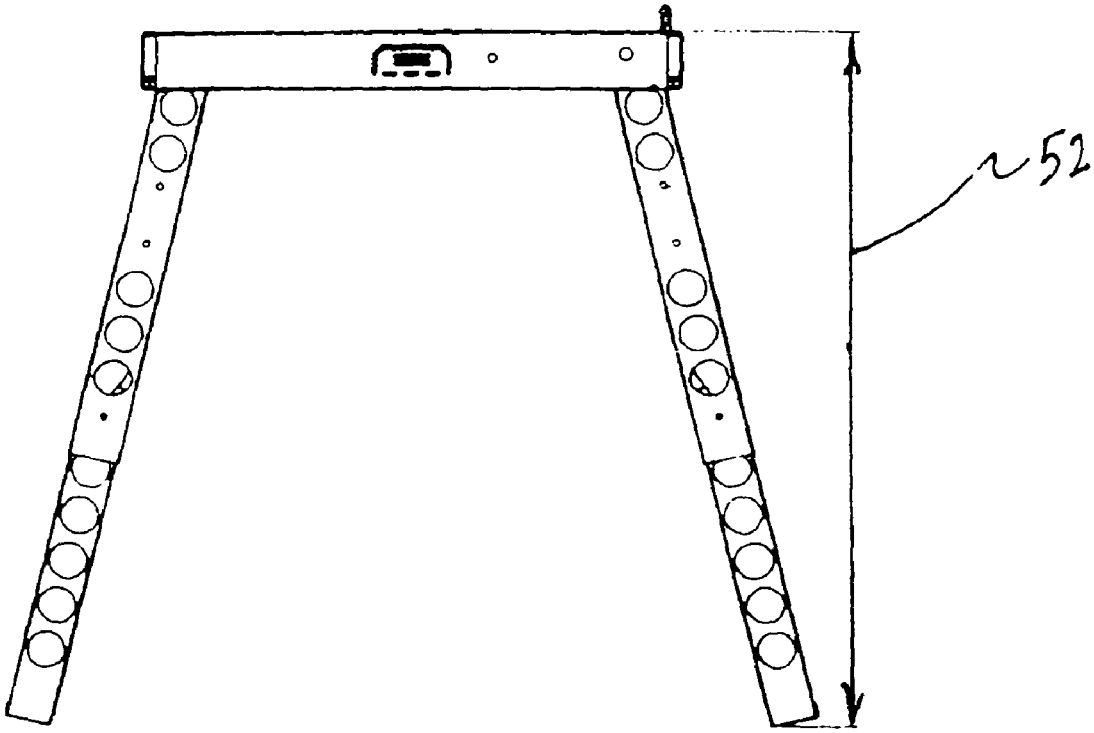
FIG. 8 is a side view of the invention in the raised position.

FIG. 8 shows a side view of the invention 100 in the raised position where the height 52 of the table top is approximately twenty-four inches. In the raised position the centerline of a standard block foam style target that is strapped to the table top will be approximately 32 to 34 inches which is relative to the vital shooting height of an elk.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Target positioning system comprising:

a rectangular flat table top member having downwardly disposed side walls depending from said table top member;

three primary legs to support said table top member;

two said primary legs hinged attached to left and right rear corners of said table top member;

one said primary leg hinged attached under a center front portion of said table top member;

each said leg having a telescoping secondary leg member; and each said secondary leg member capable of being attached, by means of a spring loaded pin that passes through aligning apertures in both said leg members to said primary leg member to adjust the height of said primary leg member;

said table top member left and right side walls including centrally disposed slots for receiving a flexible strap;

said strap, a flexible strap, capable of being adjusted by standard clasp means.

2. Target positioning system as claimed in claim 1 wherein said flat table top member includes a plurality of upwardly facing flanges mounted perpendicular to said table top and located at the rear edge of said table top;

said flanges capable of preventing a standard target block from being thrust backward during target practice.

3. Target positioning system as claimed in claim 1 wherein said table top member and said legs are constructed of eighteen gauge galvanized stainless steel.

4. target positioning system as claimed in claim 1 wherein said table top member is approximately twenty inches square and said side walls are approximately two inches tall.

5. Target positioning system as claimed in claim 1 wherein each said leg can be adjusted in length from approximately eighteen inches to approximately twenty four inches.

6. Target positioning system as claimed in claim 1 wherein said strap can be adjusted to fit over a standard square cube archery target or can be adjusted to act as a carrying strap for transporting said target positioning system to a desired location.

7. Target positioning system as claimed in claim 1 wherein said legs include a bottom aperture for retaining a stake for added stability.

* * * * *